United States Patent [19]

Smart

[11] 4,133,364

[45] Jan. 9, 1979

[54] DIAGONAL BRACING FOR LEAD POST OF FOLDING PARTITION

[75] Inventor: Jay A. Smart, Salt Lake City, Utah

[73] Assignee: Jay A. Smart Research, Ltd., Salt Lake City, Utah

[21] Appl. No.: 866,403

[22] Filed: Dec. 30, 1977

[51] Int. Cl.[2] ..... E05F 15/06

[52] U.S. Cl. ..... 160/84 R

[58] Field of Search ..... 160/84 R, 84 V, 84 M, 160/331

[56] References Cited

U.S. PATENT DOCUMENTS

| | | | |
|---|---|---|---|
| 3,509,934 | 5/1970 | Smart | 160/84 R |
| 3,720,254 | 3/1973 | Smart | 160/84 R |

FOREIGN PATENT DOCUMENTS

| | | | |
|---|---|---|---|
| 2555227 | 6/1977 | Fed. Rep. of Germany | 160/84 V |
| 1344381 | 10/1963 | France | 160/84 M |

*Primary Examiner*—Peter M. Caun

*Attorney, Agent, or Firm*—Clarence A. O'Brien; Harvey B. Jacobson

[57] ABSTRACT

A lead post assembly is provided for an elongated overhead track along which a folding partition including a leading edge is to be extended and retracted. The lead post assembly includes a carriage guidingly engaged with the track for shifting therealong and a vertical lead post member whose upper end portion is pivotally suspended from the carriage. A horizontal bar underlies the track and extends longitudinally therealong with one end of the bar being rigidly anchored relative to the carriage and the other end of the bar projecting along the track in the direction of retraction of the lead post assembly therealong. A guide is guidingly engaged with the track for shifting therealong and to which the other end of the bar is rigidly anchored. An elongated inclined brace member is provided and first and second attaching structures attach the upper and lower ends of the brace member to the guide and to the lead post member at a point spaced appreciately below the carriage. The upper end of the inclined brace member is pivotally attached to a longitudinal midportion of an elongated mounting plate extending longitudinally of the track and supported from the bar for angular displacement of the mounting plate relative to the bar about a horizontal axis transverse to the brace and bar.

10 Claims, 6 Drawing Figures

72
66
78
76
54
74
84
86
88
94
90
96
80
64
72
68
114
112
82
88
92

10
2
56
52
98
100
16
54
90
4
82
96
94
116
118
14
4
2

16
18
22
24
30
36
38
40
42
44
46
48
50
52
54
56
58
60
62
66
68
70
72
74
82
88
90
92
98
100
102
114

DIAGONAL BRACING FOR LEAD POST OF FOLDING PARTITION

BACKGROUND OF THE INVENTION

Many different forms of folding partitions supported from overhead tracks have been heretofore provided and many of these partitions utilize lead posts for the leading edge portions of the partitions whereby the leading edge portions may be maintained substantially vertical. However, if a lead post is suspended vertically beneath a carriage supported from the overhead track and braced relative to the carriage in order to prevent the lower end of the lead post from trailing in the direction of extension of the lead post, considerable stresses must be withstood at the connection of the upper end of the lead post to the carriage and the latter tends to be angularly displaced, in pitch relation, relative to the track.

Accordingly, a need exists for a lead post assembly for an overhead folding partition which will be capable of being maintained in a vertical position without placing undue stresses on the upper end of the lead post member or upon the carriage guidingly engaged with the track and from which the lead post is suspended.

BRIEF DESCRIPTION OF THE INVENTION

The lead post assembly of the instant invention includes a carriage guidingly engaged with the associated overhead track and a lead post member is pivotally suspended from the carriage. A horizontal bar underlies the track and extends longitudinally therealong with one end of the bar being rigidly anchored relative to the carriage and the other end of the bar projecting along the track in the direction of retracting of the lead post assembly therealong. A guide is guidingly engaged with the track for movement therealong and to which the other end of the bar is rigidly anchored. An elongated inclined brace member is provided and first and second attaching structures attach the upper and lower ends of the brace member to the guide and to the lead post member at a point spaced appreciably below the carriage. The first attaching structure by which the upper end of the inclined brace member is attached to the guide includes an elongated mounting plate extending longitudinally of the overhead track and is supported from the guide for angular adjustment about a horizontal axis extending transversely of the track and the upper end of the brace member is pivotally attached to a longitudinal midportion of the mounting plate for angular displacement relative thereto about a horizontal axis extending transversely to the brace and the mounting plate.

The main object of this invention is to provide a lead post assembly for an overhead track supported folding partition and which will be capable of maintaining the leading edge of the partition vertical without placing undue stresses on the lead post assembly or guide structures guidingly engaged with the overhead track from which the lead post assembly is suspended.

Another object of this invention is to provide an improved lead post assembly for use in conjunction with double panel folding partitions with the lead post assembly and the diagonal bracing therefor being interposed between the double folding panels of the partition.

Still another important object of this invention is to provide a lead post assembly for an overhead suspended folding partition and improved drive structure for extending and retracting the lead post assembly.

A further important object of this invention is to provide a lead post assembly in accordance with the preceding objects and constructed in a manner whereby angular displacement of the lead post relative to the overhead track from which it is supported may be slightly adjusted as desired.

A final object of this invention to be specifically enumerated herein is to provide an improved lead post assembly for an overhead suspended folding partition and which will conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 4:
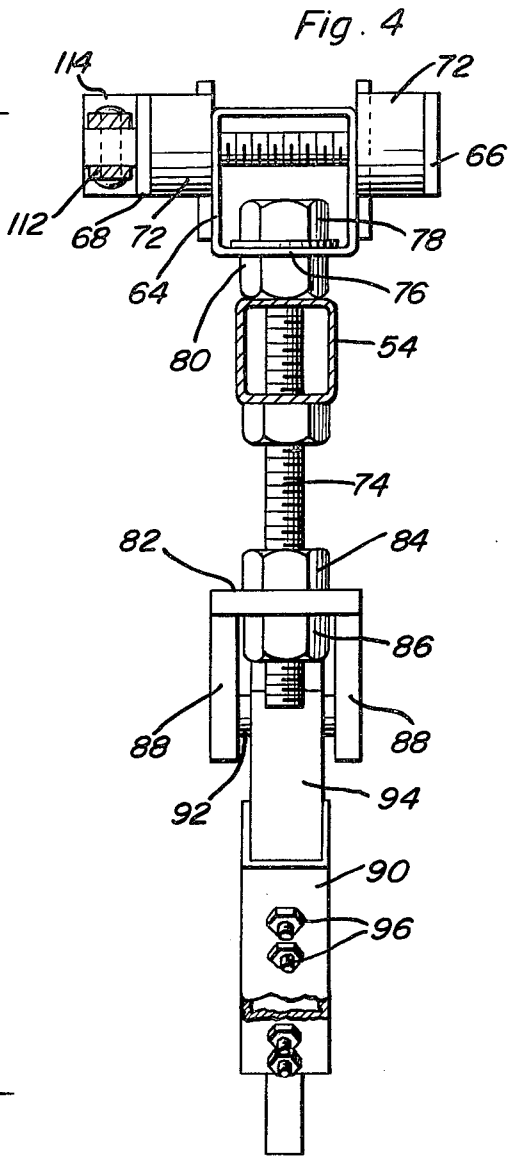
FIG. 4 is a fragmentary, enlarged, vertical sectional view taken substantially upon the plane indicated by the section line 4—4 of FIG. 1.
Figure 1:
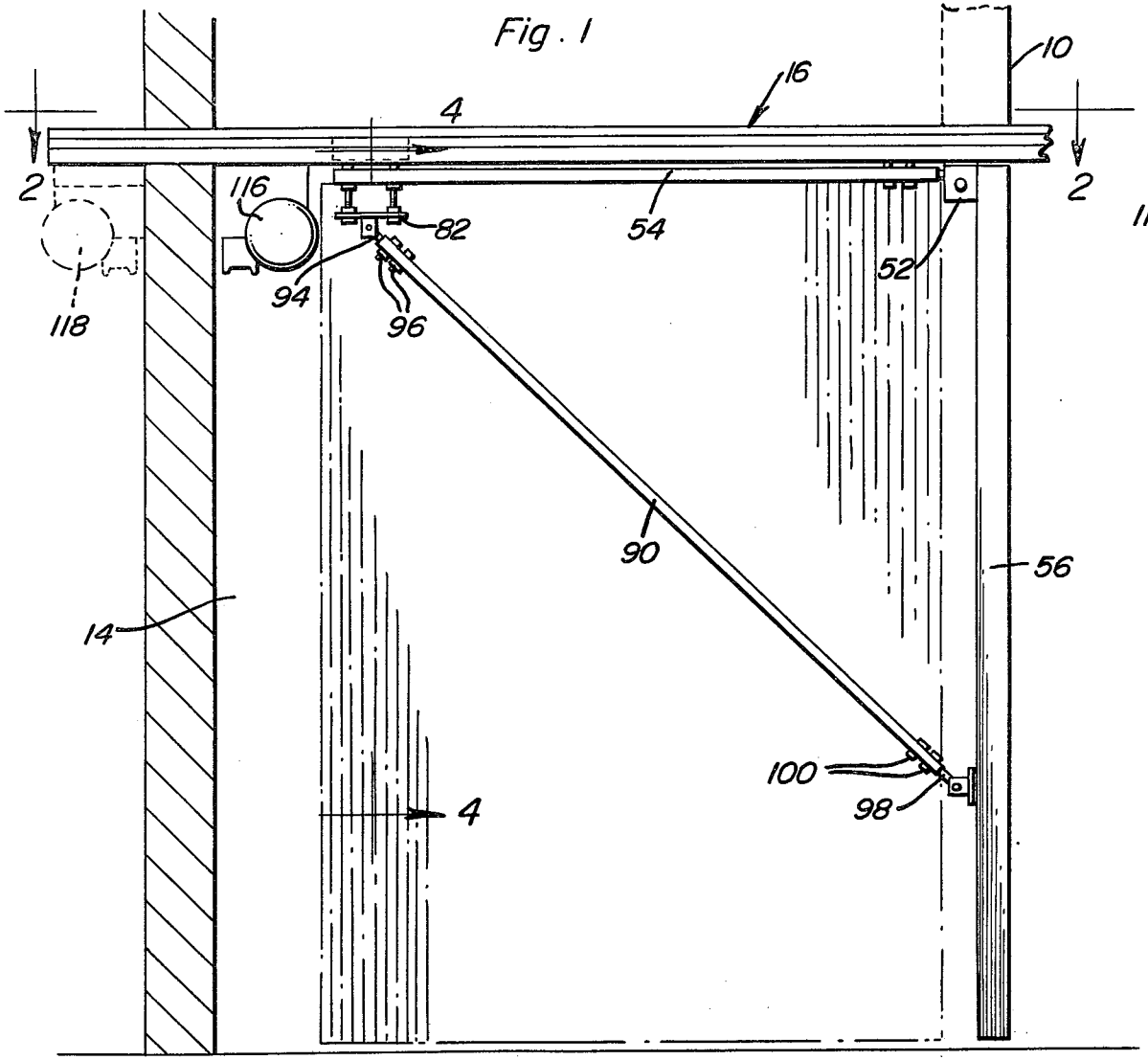
FIG. 1 is an elevational view of the lead post assembly of the instant invention in a fully retracted position within a wall recess.

Referring now more specifically to the drawings, the numeral 10 designates a first vertical wall and the numeral 12 designates a second vertical wall opposing the wall 10. The first wall 10 includes a recess 14 opening horizontally outwardly therethrough toward the wall 12 and a header assembly referred to in general by the reference numeral 16 extends between upper portions of the walls 10 and 12 and into the recess 14. The header assembly 16 supports a track assembly referred to in general by the reference numeral 18 therefrom and the track assembly 18 includes a center section referred to in general by the reference numeral 20 and a pair of opposite side sections referred to in general by the reference numeral 22. The center section 20 defines a central downwardly opening slot 24 and pairs of opposite side vertically spaced downwardly and upwardly facing bearing surfaces 26 and 28 disposed immediately on opposite sides of the slot 24 as well as opposite side compartments 30 and 32 disposed on the remote sides of the pairs of vertically spaced bearing surfaces 26 and 28. Also, the side sections 22 each define a central downwardly opening slot 34 and pairs of opposite side downwardly and upwardly facing upper and lower bearing surfaces 36 and 38 on opposite sides of the slots 34.

The lead post assembly of the instant invention is referred to in general by the reference numeral 40 and includes a carriage referred to in general by the reference numeral 42. The carriage 42 includes a horizontal transverse plate 44 including opposite side upstanding flanges 46 on whose opposite sides inner and outer upper wheels 48 and inner and outer lower wheels 50 are journaled. A pair of laterally spaced apart mounting flanges 52 are supported from and depend downwardly from the plate 52 and the forward end of a horizontal bar 54 is secured between the flanges 52 in any convenient manner.

The upper end of a vertical lead post member 56 is attached, by means of a single pivot fastener 58, to the mounting flanges 52 and a lower bifurcated mount 60 is supported from a lower portion of the lead post member 54 spaced appreciably below the carriage 42.

The end of the bar 54 remote from the carriage 42 supports a guide or stabilizer assembly 62 therefrom and the stabilizer assembly 62 includes a longitudinally extending tubular member 64 from whose opposite sides nylon guide structures 66 and 68 are removably supported, the structures 66 and 68 including rounded end caps 70 and 72 at their front and rear ends. The tubular member is supported from the rear end of the bar 54 by means of a pair of vertical threaded shank members 74 secured upwardly through the bar 54 at points spaced longitudinally therealong and secured through longitudinally spaced portions of the bottom wall 76 of the tubular member 64 by means of jamb nuts 78 and 80. The lower ends of the threaded shanks members 74 are adjustably secured downwardly through longitudinally spaced portions of a elongated mounting bar 82 by means of jamb nuts 84 and 86 and opposite side longitudinal midportions of the mounting bar 82 include depending mounting flanges 88 between which the upper end of an elongated inclined brace member 90 is pivotally secured by means of a pivot fastener 92. The upper end of the brace member 90 includes an extendible upper end section 94 secured in adjusted extended position by means of fasteners 96 and the lower end of the brace member 90 includes a similar longitudinally extendible end section 98 secured in adjusted position by means of fasteners 100, the end section 98 being pivotally supported from the bifurcated mount 60 by means of a pivot fastener 102.

The end of the center section 20 of the track assembly 18 remote from the recess 14 has a horizontal idle sprocket 106 journaled therein from a support structure 108 supported from the center section 20 for adjustable positioning longitudinally therealong and the terminal end of the center section 20 disposed within the recess 14 has a reversely drivable sprocket 110 journaled therein.

Figure 2:
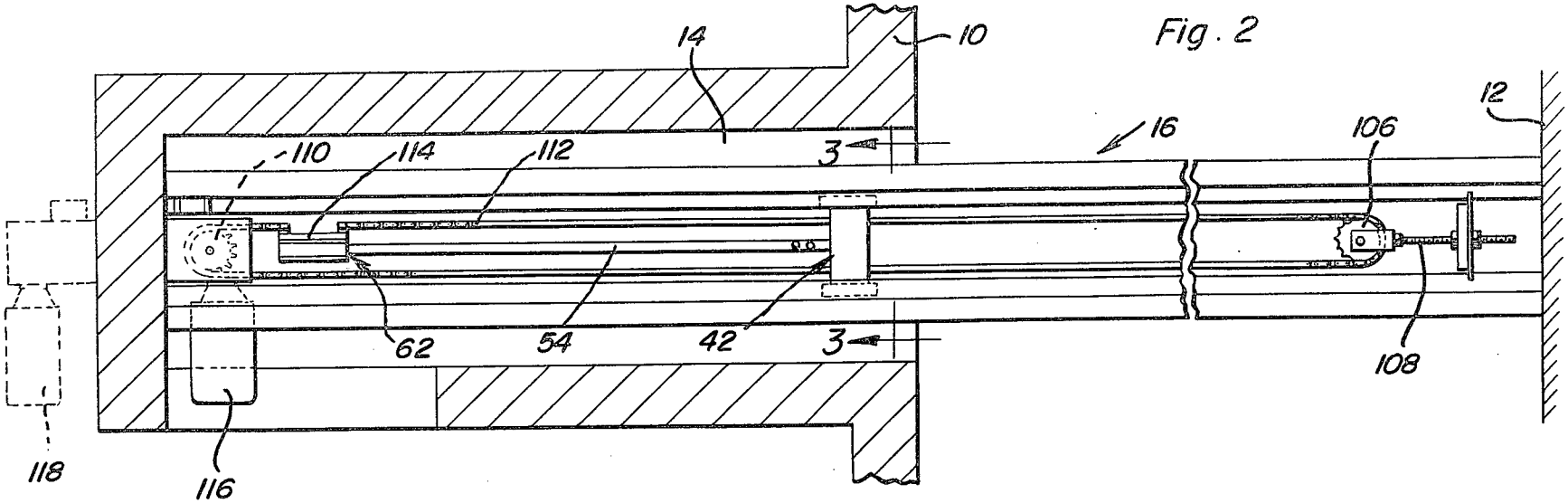
FIG. 2 is a fragmentary, vertical sectional view taken substantially upon the plane indicated by the section line 2—2 of FIG. 1.
Figure 3:
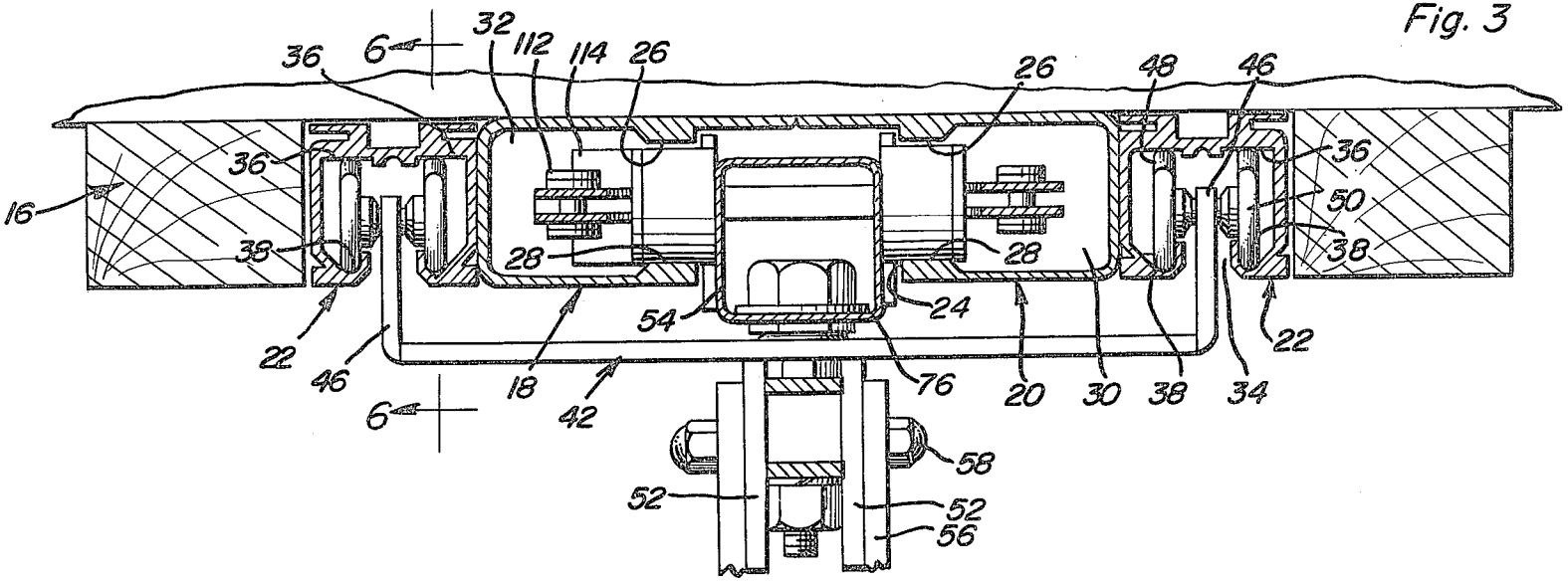
FIG. 3 is an enlarged, fragmentary, vertical sectional view taken substantially upon the plane indicated by the section line 3—3 of FIG. 2.
Figures 5, 6:
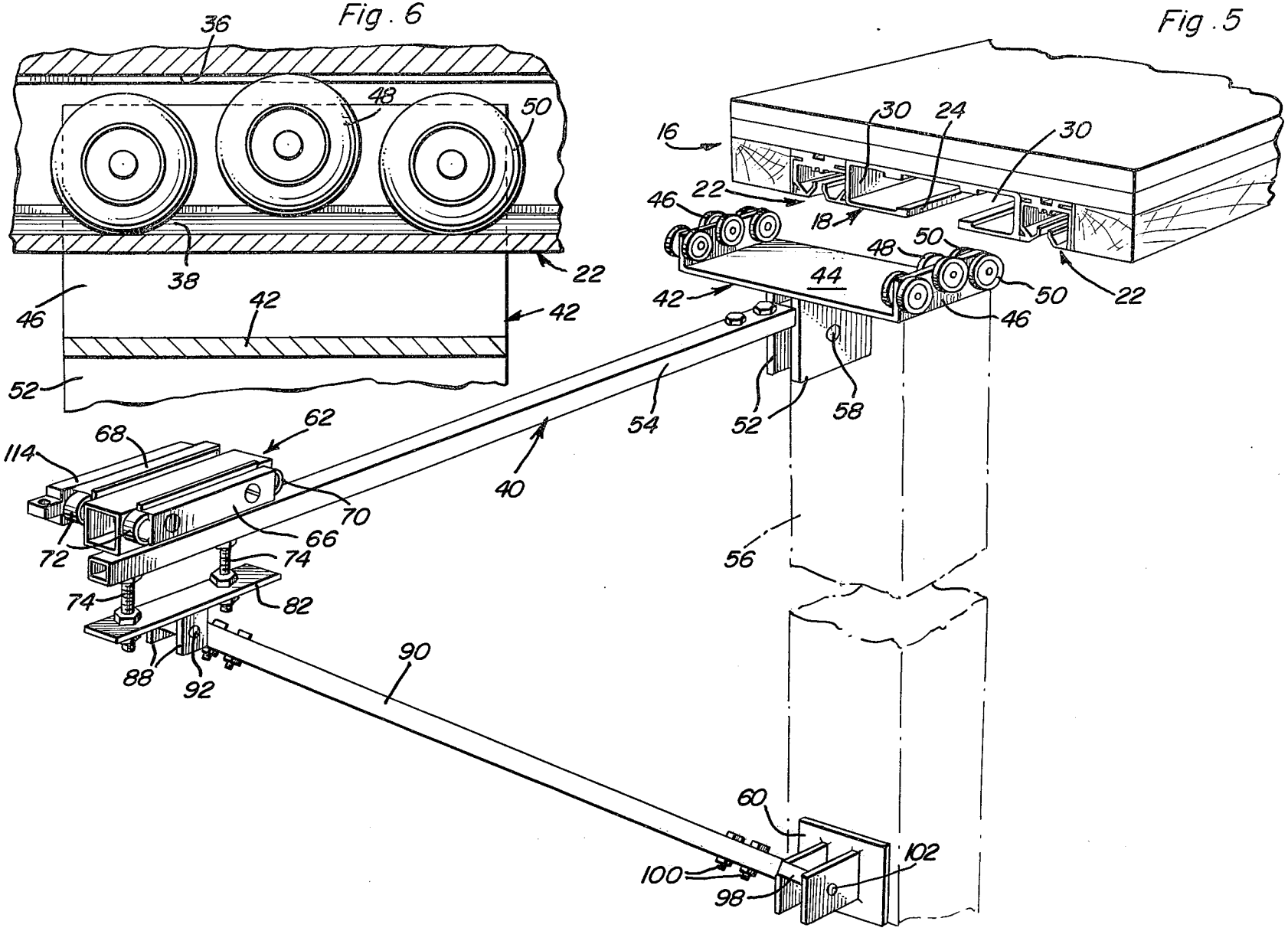
FIG. 5 is a fragmentary, perspective view of the lead post assembly in exploded relation relative to a fragmentarily illustrated portion of the associated overhead track.
FIG. 6 is an enlarged, fragmentary, vertical sectional view taken substantially upon the plane indicated by the section line 6—6 of FIG. 3.

A chain 112 is trained about the sprockets 106 and 110 and the opposite end portions of the chain 112 are anchored relative to an anchor member 114 carried by the outer side of the guide structure 68, the opposite side reaches of the chain being received and longitudinally shiftable in the compartments 30 and 32. Accordingly, upon reversely driving the sprocket 110, the lead post assembly 40 may be extended and retracted toward and away from the wall 12. It will be noted from FIG. 2 of the drawings that the reversely drivable sprocket 110 is driven from a motor 116 within the recess 14. However, the motor 116 may be substituted for by a motor 118 mounted exteriorly of the recess 14.

The upper and lower peripheries of the wheels 48 and 50 rollingly engage the bearing surfaces 36 and 38 and the upper and lower surfaces of the guide structures 66 and 68 may engage the corresponding upper and lower bearing surfaces 26 and 28 of the central section 20 of the track assembly 18.

By raising or lowering the mounting plate 82, the effective length of the brace member 90 is adjusted. Lowering of the plate 82 tends to incline the lead post member 56 toward a position with its lower end advanced relative to its upper end, whereas raising the mounting plate 82 causes the lower end of the lead post member 56 to trail in the direction of extension of the lead post member 56 relative to the upper end thereof. In addition, the pitch attitude of the mounting plate 82 may be adjusted whereby the intersection of the center line of the brace 90 with the mounting plate 82 may be shifted longitudinally of the latter. Thus, by adjusting the pitch attitude of the mounting plte 82 after the lead post member has been adjusted through vertical shifting of the mounting plate 82, all forces tending to adversely effect the pitch attitude of the stabilizer or guide 62 may be eliminated and the front and rear ends of the guide or stabilizer 62 may bear evenly upon the bearing surfaces 26.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination, an elongated overhead track, a lead post assembly for a foldable barrier including a leading edge to be extended and retracted along and beneath said track, said lead post assembly including a vertical lead post member, a carriage guidingly engaged with said track for shifting therealong, the upper end portion of said lead post member being supported and suspended from said carriage, a horizontal bar underlying said track and extending longitudinally therealong, one end of said bar being anchored relative to said carriage and the other end of said bar projecting along said track in the direction of retraction of said lead post assembly therealong, a guide guidingly engaged with said track for shifting therealong and to which the other end of said bar is anchored, an elongated inclined brace member, and first and second attaching structure attaching the upper and lower ends of said brace member to said guide and said lead post member at a point spaced appreciably below said carriage.

2. The combination of claim 1 wherein said first attaching structure includes means operative to adjustably vertically shift said upper end of said brace member relative to said guide.

3. The combination of claim 1 wherein said guide is elongated and guidingly engages longitudinally spaced portions of said track, said first attaching structure including an elongated mounting plate extending longitudinally of said bar and supported therefrom for angular adjustment about a horizontal axis extending transversely of said bar, said first attaching structure pivotally attaching the upper end of said brace member to a longitudinal midportion of said mounting plate for angular displacement relative thereto about a second horizontal axis transverse to said brace and mounting plate.

4. The combination of claim 1 wherein said track includes opposite side track portions defining opposing downwardly and upwardly facing vertically spaced upper and lower track surfaces, respectively, said carriage including opposite side sets of longitudinally spaced wheels journaled therefrom for rotation about vertically spaced upper and lower horizontal axes, the wheels journaled for rotation about said upper and lower axes including upper and lower peripheral portions, respectively, rollingly engaged with said upper and lower track surfaces, respectively.

5. The combination of claim 1 wherein the end of said track toward which said lead post assembly is extendible includes a horizontal idle sprocket journaled therein, a horizontal reversely drivable sprocket journaled in the other end of said track, a drive chain trained about said sprockets, the ends of said drive chain being anchored relative to said guide.

6. A lead post structure for an overhead track supported folding partition, said structure including a carriage and a guide assembly guidingly engaged with said track at points spaced therealong for guided movement along said track, a horizontal bar extending between and rigidly connecting said guide assembly and carriage, a vertical lead post assembly pivotally supported at its upper end from said carriage assembly for angular displacement about a horizontal axis extending transversely of said track, an elongated inclined brace member and first and second attaching structure attaching the upper and lower ends of said brace member to said guide assembly and lead post assembly, respectively, at least one of said attaching structures including means adjustably attaching the corresponding end of said brace member to the associated assembly whereby the effective length of said brace may be adjusted.

7. The combination of claim 6 wherein said first and second attaching structures include means pivotally attaching the upper and lower ends of said brace member to said guide and lead post assemblies, respectively.

8. The combination of claim 6 wherein said guide assembly is elongated and guidingly engages longitudinally spaced portions of said track, said first attaching structure including an elongated mounting plate extending longitudinally of said bar and supported therefrom for angular adjustment about a horizontal axis extending transversely of said bar, said first attaching structure pivotally attaching the upper end of said brace member to a longitudinal midportion of said mounting plate for angular displacement relative thereto about a second horizontal axis transverse to said brace and mounting plate.

9. The combination of claim 8 wherein said track includes opposite side track portions defining opposing downwardly and upwardly facing vertically spaced upper and lower track surfaces, respectively, said carriage including opposite side sets of longitudinally spaced wheels journaled therefrom for rotation about vertically spaced upper and lower horizontal axes, the wheels journaled for rotation about said upper and lower axes including upper and lower peripheral portions, respectively, rollingly engaged with said upper and lower track surfaces, respectively.

10. The combination of claim 6 wherein said first attaching means includes means operative to adjustably vertically shift said upper end of said brace member relative to said guide assembly.

* * * * *